US005716234A

United States Patent [19]

Phillips

[11] Patent Number: 5,716,234

[45] Date of Patent: Feb. 10, 1998

[54] ELECTRICAL CONNECTOR WITH POSITIVE LOCK RETENTION

[75] Inventor: Kevin Paul Phillips, Chagrin Falls, Ohio

[73] Assignee: General Motors Corporation, Detroit, Mich.

[21] Appl. No.: 724,980

[22] Filed: Oct. 3, 1996

[51] Int. Cl.[6] ..... H01R 13/40

[52] U.S. Cl. ..... 439/595

[58] Field of Search ..... 439/595, 752

[56] References Cited

U.S. PATENT DOCUMENTS

| | | | |
|---|---|---|---|
| 4,826,452 | 5/1989 | Sian et al. | 439/595 |
| 5,033,980 | 7/1991 | Watanabe et al. | 439/595 |
| 5,066,252 | 11/1991 | Kato et al. | 439/595 |
| 5,066,253 | 11/1991 | Kameyama | 439/595 |
| 5,067,913 | 11/1991 | Sagawa | 439/595 |
| 5,071,373 | 12/1991 | Nagasaka et al. | 439/595 |
| 5,205,763 | 4/1993 | Watanabe et al. | 439/595 |
| 5,209,676 | 5/1993 | Endo et al. | 439/595 |
| 5,292,261 | 3/1994 | Hirano et al. | 439/595 |
| 5,292,262 | 3/1994 | Endo et al. | 439/595 |
| 5,299,959 | 4/1994 | Yanamoto et al. | 439/595 |
| 5,322,457 | 6/1994 | Tsuji et al. | 439/595 |
| 5,397,249 | 3/1995 | Endo et al. | 439/595 |
| 5,455,515 | 10/1995 | Saijo et al. | 439/595 |
| 5,522,740 | 6/1996 | Plocek et al. | 439/752 |
| 5,569,055 | 10/1996 | Yamanashi et al. | 439/752 |
| 5,575,683 | 11/1996 | Saito et al. | 439/595 |

*Primary Examiner*—Gary F. Paumen
*Assistant Examiner*—Katrina Davis
*Attorney, Agent, or Firm*—Anthony Luke Simon

[57] ABSTRACT

An electrical connector with positive lock retention comprising: a connector housing with a first wall having first and second ramp locks at first and second longitudinal positions along the first wall; and a positive lock retention component comprising a first longitudinally extending lock feature including a first cross member forming a T-shape in the first lock feature, extending first and second lateral directions therefrom, wherein the positive lock retention component is locked in a first state of insertion engagement with the connector housing when the first cross member is located longitudinally between the first and second ramp locks and wherein the positive lock retention component is locked in a second state of insertion engagement with the connector housing when the first cross member is locked behind the second ramp lock.

10 Claims, 7 Drawing Sheets

ELECTRICAL CONNECTOR WITH POSITIVE LOCK RETENTION

This invention relates to an electrical connector with positive lock retention.

BACKGROUND OF THE INVENTION

Positive lock retention component (PLR's) are commonly used in the electrical connector industry to maintain connectors assembled. For example, a positive lock retainer may be used with a connector housing and fastened in place once the terminals and wires are located within the housing along with other required internal components, if any. The positive lock retainer operates, for example, to ensure positive locking of the terminals in place within the housing. Typically, the positive lock retainer is itself maintained in place by a snap-in feature.

Known positive lock retainers include one stage and two stage retainers. A one stage retainer has only two possible states: (i) disassembled from the housing and (ii) assembled to the housing. A two stage retainer can be assembled into the housing in an intermediate position (first stage) that still allows assembly of the terminals into the housing, after which, the two stage retainer is pushed to its second and final stage.

Two stage retainers are advantageous in that they allow flexibility in manufacturing. For example, the two stage retainer can be used as a single stage retainer wherein it is not attached to the housing at all until the terminals are completely assembled therein, at which point it is fastened in place in its final position. Alternatively, the PLR can be attached to the housing in the first stage before the inner components are assembled into the housing, allowing the PLR and housing to be shipped and/or handled as a single unit. When the components are assembled within the housing, the PLR is positioned to the second and final stage.

SUMMARY OF THE PRESENT INVENTION

It is an object of this invention to provide an electrical connector with positive lock retention according to Claim 1

Advantageously, this invention provides an electrical connector with a positive lock retainer having improved two-stage operation.

Advantageously, this invention provides an electrical connector with a positive lock retainer that is positionally guided into the housing during initial assembly, that locks into the housing in a first stage during which assembly of connector components is still achievable and then locks into the housing in a second stage, securing final assembly of the electrical connector.

Advantageously, according to a preferred example of this invention, an electrical connector with positive lock retention is provided comprising: a connector housing with a wall having first and second ramp locks at first and second longitudinal positions along the connector wall; and a positive lock retention component comprising a longitudinally extending lock feature including a cross member forming a T-shape in the lock feature, extending first and second lateral directions therefrom, wherein the positive lock retention component is locked in a first state of insertion engagement with the connector housing when the cross member is located longitudinally between the first and second ramp locks and wherein the positive lock retention component is locked in a second state of insertion engagement with the connector housing when the cross member is locked behind the second ramp lock.

BRIEF DESCRIPTION OF THE DRAWINGS

The present invention will now be described by way of example with reference to the following figures in which.

DETAILED DESCRIPTION OF THE INVENTION

Figure 1:
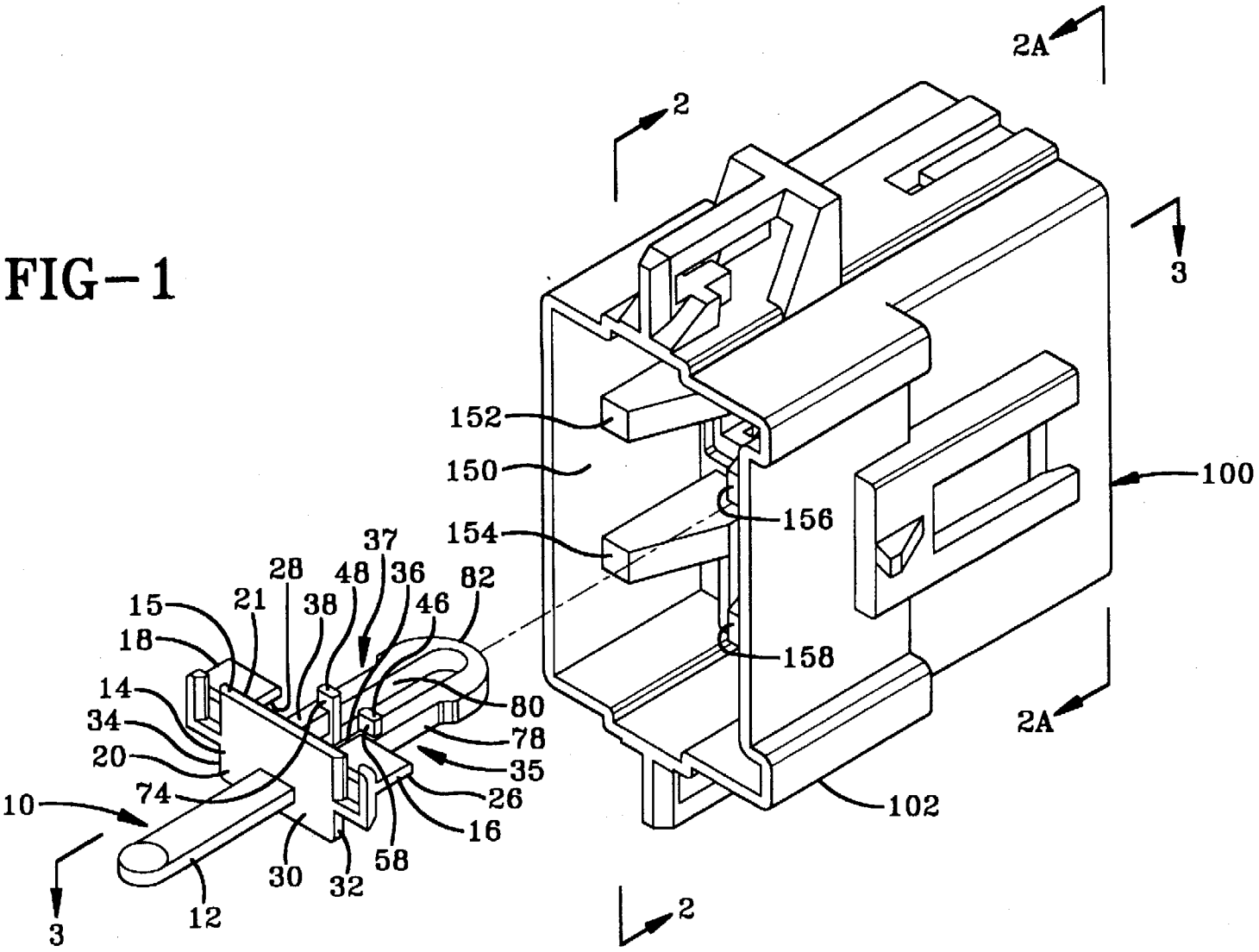
FIGS. 1–2A illustrate an example positive lock retainer and associated connector housing according to this invention.

Referring now to FIG. 1, the positive lock retainer (PLR) 10 shown has a substantially flat end wall 14 with a first surface 20 and a second surface 21 opposite surface 20. The end wall 14 has a top edge 15, a bottom edge 30 and lateral edges 32 and 34. Manipulation grip 12 extends perpendicularly out of surface 20 as shown and is a solid, substantially flat extension that facilitates operator handling of the PLR 10. The manipulation grip 12 is most useful in examples where the PLR 10 engages a housing that includes extending walls to enshroud PLR 10 when assembled thereto.

Proximate to the first lateral edge 32, a first tab 16 extends perpendicularly out of the end wall 14, opposite the direction of the manipulation grip 12. Similarly, proximate to the second lateral edge 34, tab 18 extends perpendicularly out of the end wall 14, also in a direction opposite that of the manipulation grip 12. The tabs 16 and 18 have planar surfaces 26 and 28 parallel to the edge 15 of the wall 14. In engagement with a housing (described below), the tabs 16 and 18 act as locks on cantilever retention fingers within the housing, preventing the fingers from moving from a state in which they maintain connector terminals locked in place within the housing.

At a more central location with respect to the first lateral edge 32, the lock feature 35 protrudes perpendicularly from the end wall 14 in the direction opposite that of the manipulation grip 12. The lock feature 35 has a longitudinal extension 36 leading to a cross member 46, which projects laterally in first and second directions from the longitudinal extension 36 to form a T-shape with cross member 46 parallel to the lateral edge 32. The cross member 46 has leading surfaces (facing away from end wall 14) that are preferably rounded or, alternatively, angled. The cross member also has laterally extending lock surfaces 58 that serve to lock the PLR 10 in place in the housing as described below. Longitudinal extension 36 extends past cross member 46 to form guide 78, which positions PLR 10 within the housing during initial assembly.

Proximate to the second lateral edge 34 of the end wall 14, a second lock feature 37 is located, preferably symmetrical to the first. The second lock feature 37 includes a longitudinal extension 38 projecting perpendicularly from the end wall 14 opposite the direction of the manipulation grip 12. A cross member 48 extends out of first longitudinal extension 38 parallel to lateral edge 34 and forms a T-shape with longitudinal extension 38. Similar to cross member 46, cross member 48 has leading curved surfaces and trailing locking surfaces 74. Longitudinal extension 38 extends past the cross member 48 to form guide 80, which positions PLR 10 during initial assembly to the housing. The guide 80 has an end that is connected to cross member 82, the other end of which is attached to the end of guide 78. The entire PLR structure 10 is preferably integrally molded as a single plastic component.

Figure 2A:
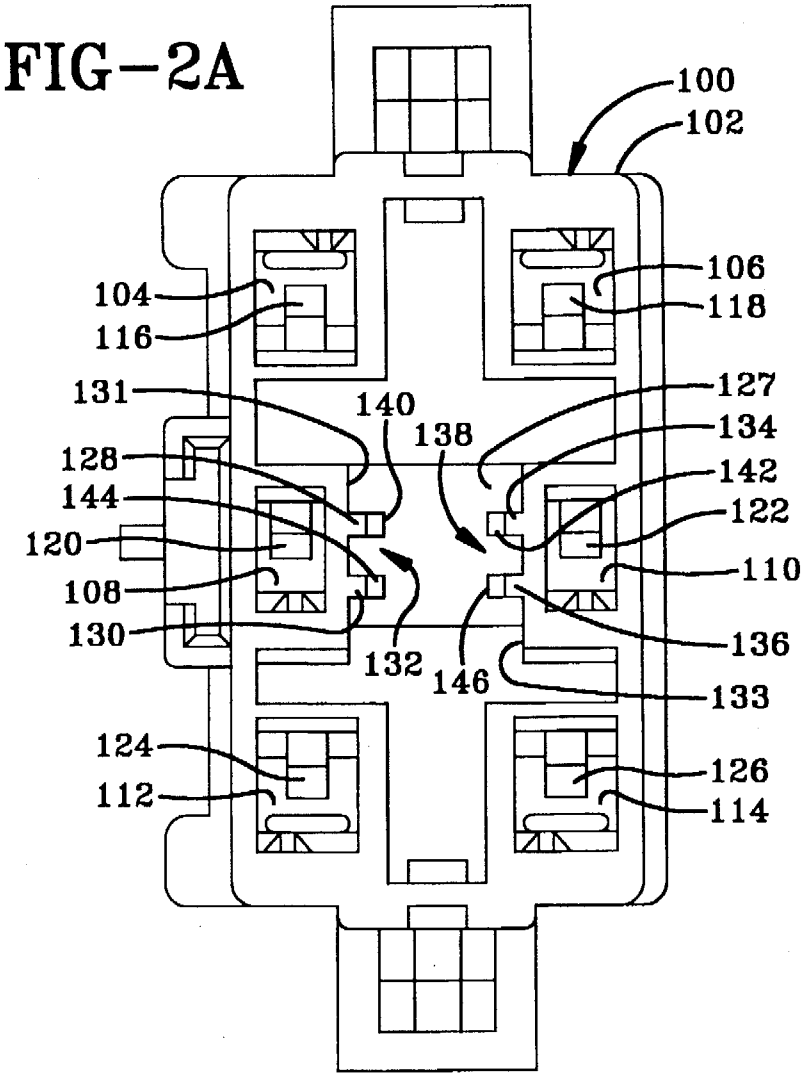
Figure 2:
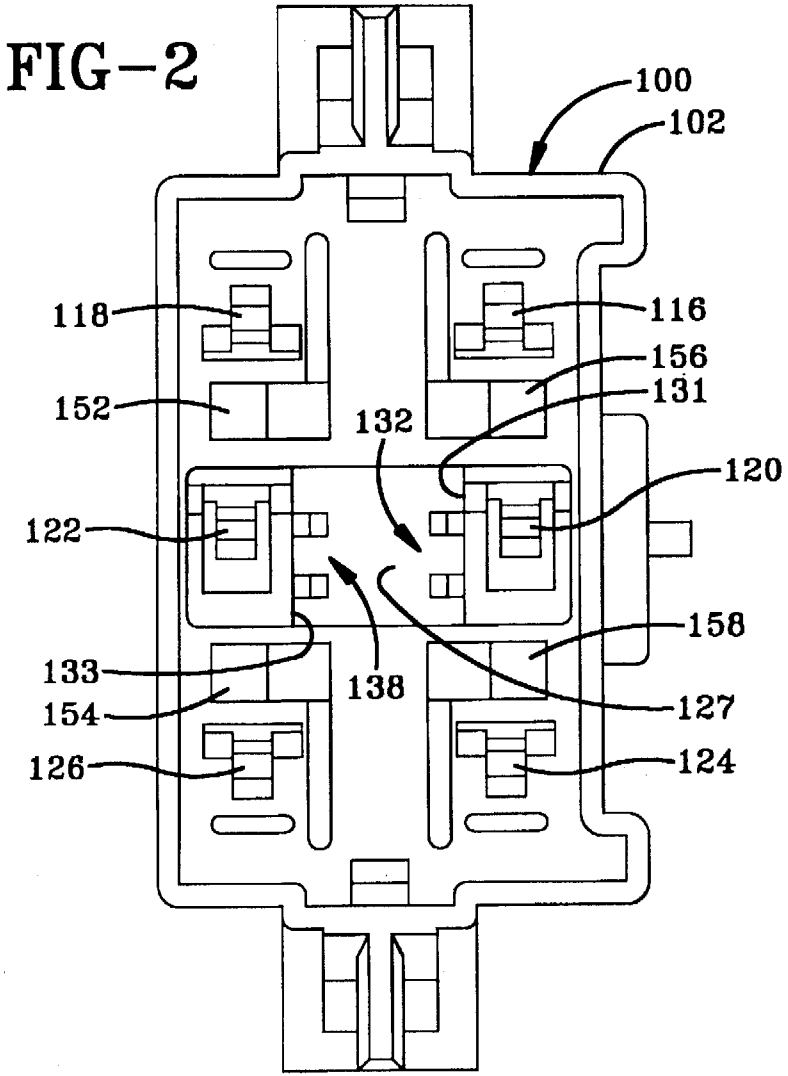

Referring now also to FIGS. 2 and 2A, an example connector housing for use with the PLR 10 in FIG. 1 is shown. The housing 100 comprises a body 102 preferably of an integrally molded plastic construction. The body 102 is adapted for receiving a plurality of electrical terminals of a known type for terminating conventional electrical harness wires of a type used in automotive electrical systems and for engagement with mating terminals in a mating housing of a known type.

More particularly, the body 102 has a plurality of cavities 104, 106, 108, 110, 112 and 114 running longitudinally therethrough for receiving the terminals. Each cavity 104–114 has therein a cantilever spring arm 116, 118, 120, 122, 124 and 126, respectively, for locking the terminals within the housing body 102 in a known manner.

Another cavity 127 extends through a central portion of the body 102 parallel to the cavities 104–114. The cavity 127 has a generally rectangular profile with walls 131 and 133 facing each other on opposite sides of the cavity. Each wall 131 and 133 has a slot 132, 138 therein, respectively, formed by guide rails 128 and 130 extending from wall 131 and guide rails 134 and 136 extending from wall 133. The guide rails 128, 130 extend substantially along the length of wall 131 and guide rails 134, 136 extend substantially along the length of wall 133.

Along the guide rails 128, 130, 134, 136 are ramp locks 140, 142, 144 and 146 that operate with the lock features 35 and 37 to retain the PLR 10 in first and second stages within the housing 100. The ramps 140, 142, 144 and 146 are divided between two stages longitudinally along the slots 132 and 138, with ramps 140 and 146 collaterally located at a first position along the slots 132, 138 and ramps 142 and 144 collaterally located at a second position along the slots 132, 138 longitudinally separated from the ramp locks 140 and 146.

In general, the housing 100 mates with a complementary connector housing (not shown) of a known type to engage terminals within the housing 100 to those within the mating connector. Part of the mating connector will engage in a known manner the front cavity 150 within which is provided locators 152, 154, 156 and 158 and within which the PLR is inserted to engage with the housing 100.

Figure 3:
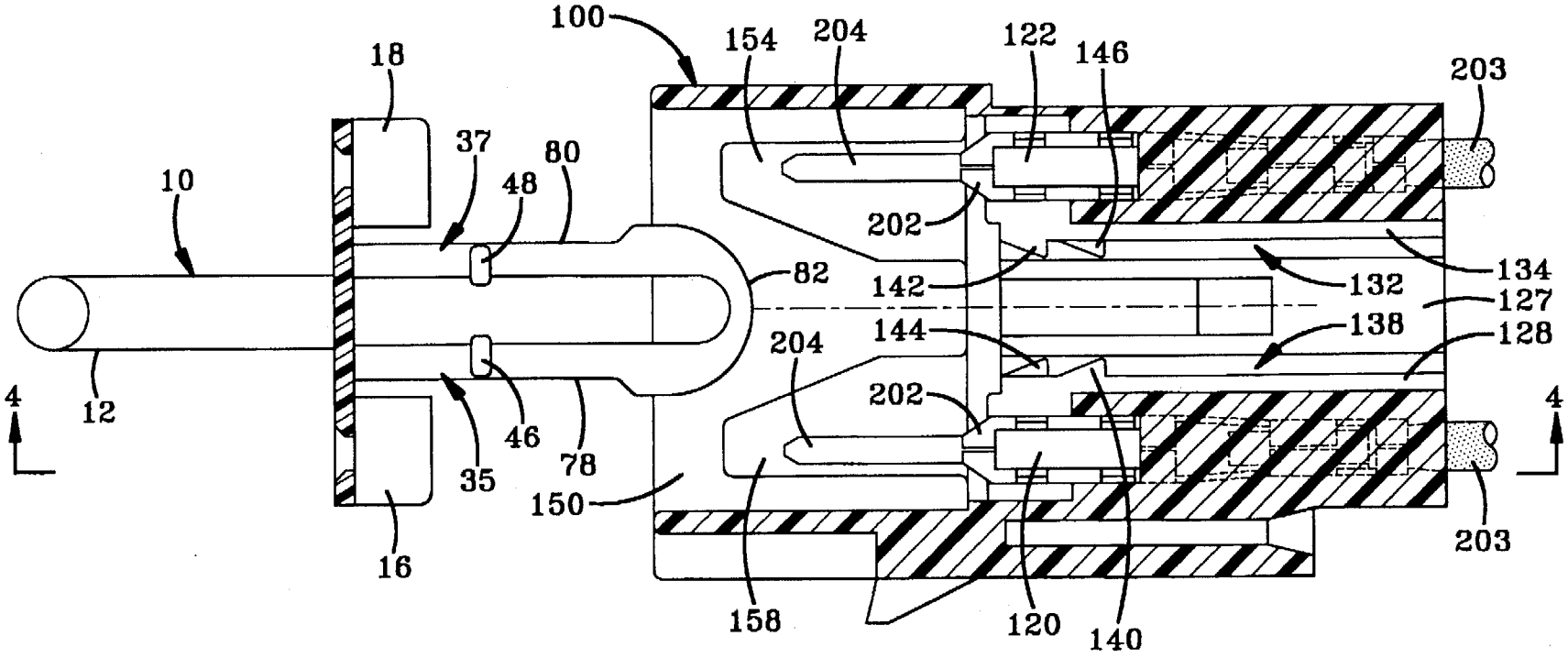
FIGS. 3–8 illustrate example two stage engagement operation of the positive lock retainer and connector housing shown in FIGS. 1–2A.
Figure 4:
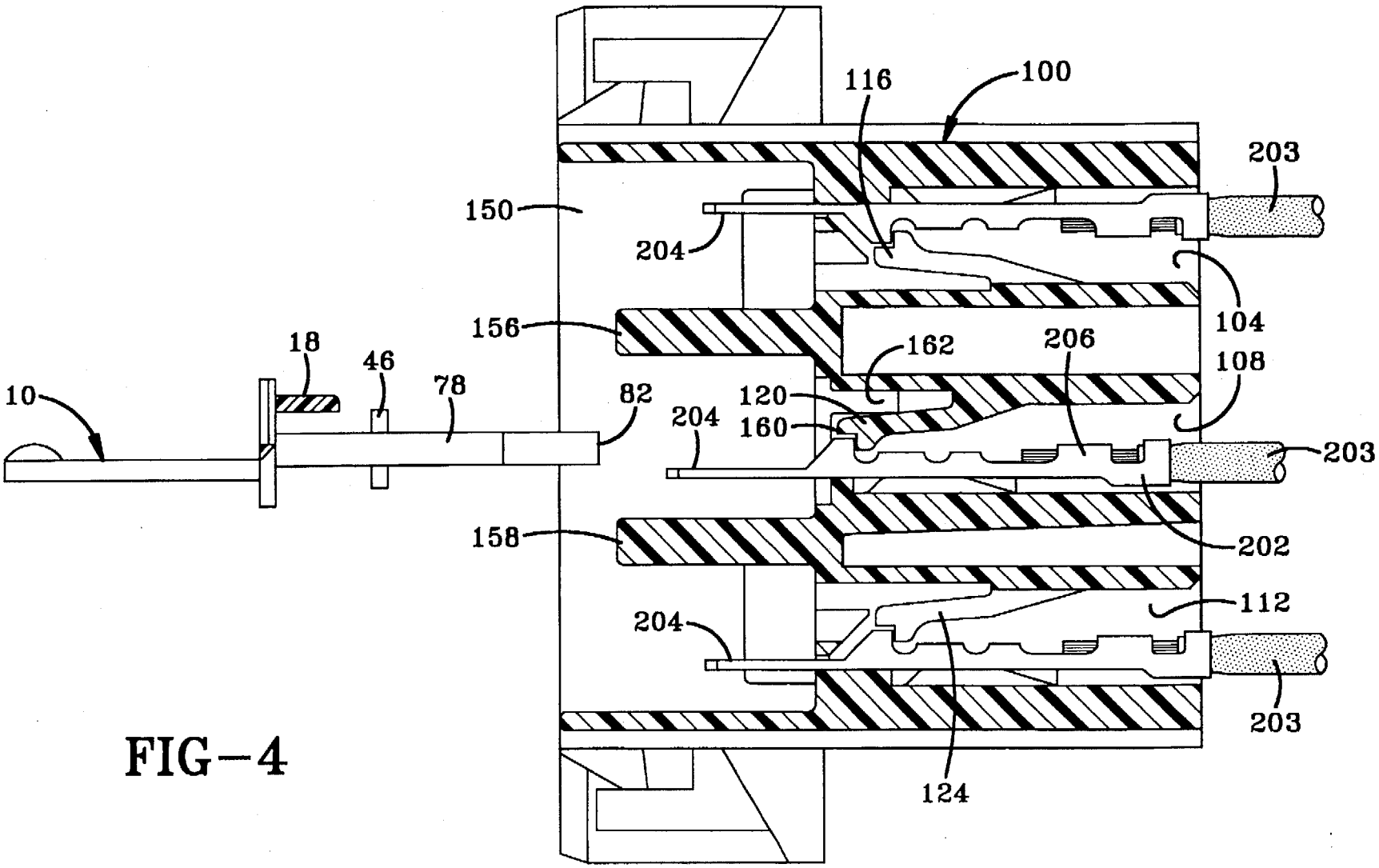

Referring now also to FIGS. 3 and 4, the first step of the engagement of PLR 10 within housing 100 is shown. The PLR 10 is positioned by a human operator so that the guides 78 and 80 slide within the slots 132 and 138 through a cavity 127 as shown. An example terminal, 202, is illustrated mounted in place within the housing body 102, held in place by the spring arm 120. Terminal 202 has a first end 204 that extends into the cavity 150 for engaging with a mating terminal (not shown) of a mating connector (also not shown) in a known manner. The other end 206 of terminal 202 terminates an electrical harness wire 203 in a known manner, for example, by crimping around an exposed conductor end of the harness wire. For the terminal 202 to be inserted into and removable from the cavity 108, the end 160 of the spring arm 120 must be able to cantilever into the space 162 above the end 160. When PLR 10 is fully in place (FIGS. 8 and 9), tab 16 prevents movement of the end 160 of spring arm 120 into the space 162, thus locking the terminal 202 in place.

Figure 5:
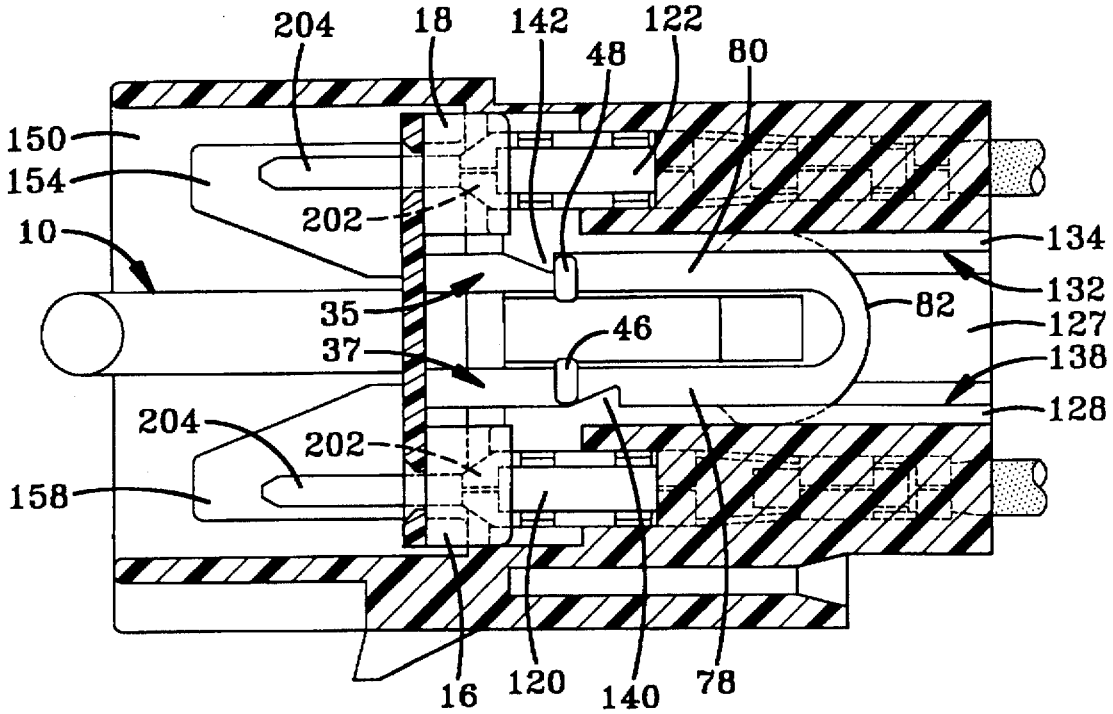
Figure 6:
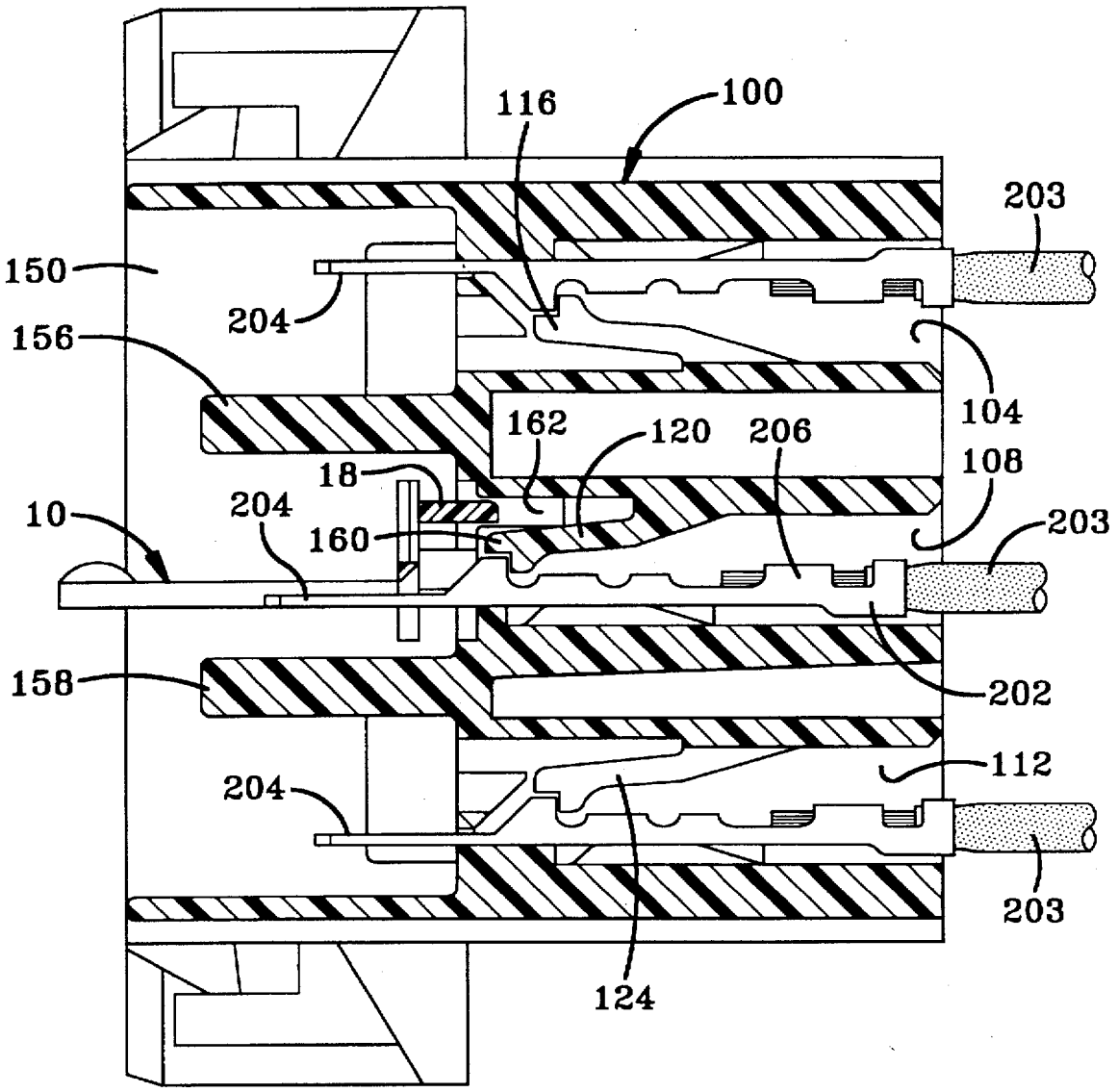

Referring now to FIGS. 5 and 6, the PLR 10 is shown locked in the first stage position within the housing body 102. The guides 78 and 80 are further within the slots 132 and 138 and the cross members 46 and 48 of lock features 35 and 37 have slid past the ramp locks 142 and 144, which prevent the PLR 10 from sliding back out of the housing body 102 unless sufficient force is provided to overcome the ramp locks 142, 144. As shown by the section view in FIG. 6, the tab 16 is not yet within the space 162 above the spring arm 120 and thus the spring arm 120 can still deflect allowing insertion of and/or removal of terminal 202 from cavity 108.

Figure 7:
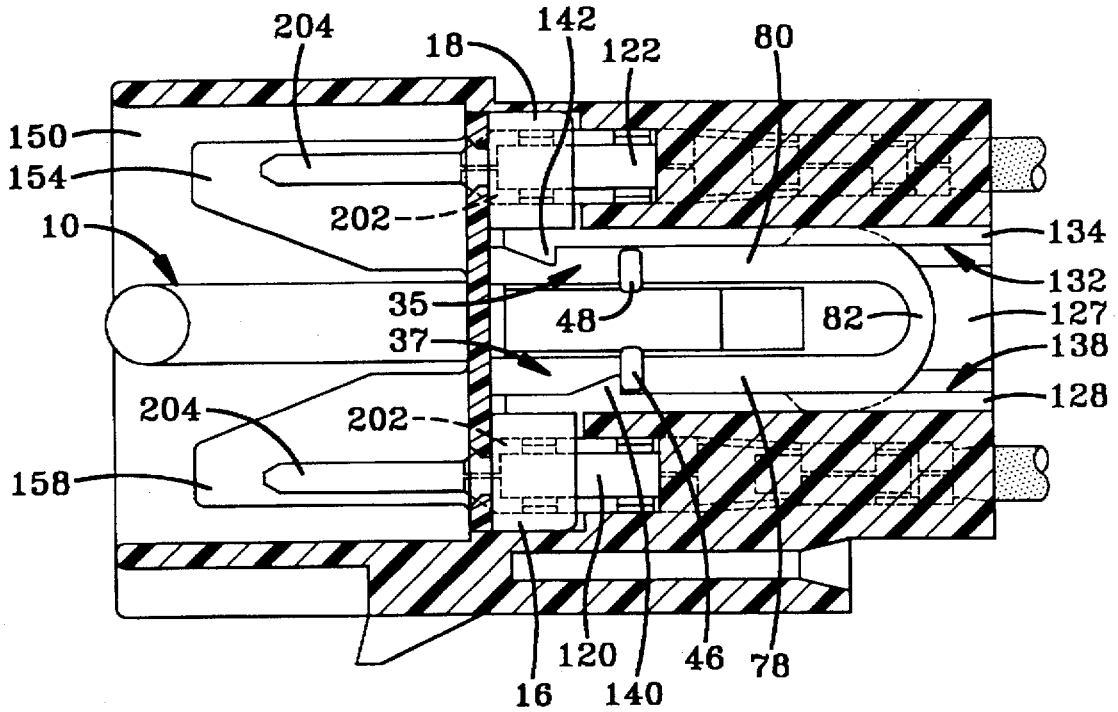

FIGS. 5 and 6 illustrate that during an example assembly operation, PLR 10 can be locked in place within the housing body 102 in the first stage before the terminals 202 are engaged therein while allowing later assembly of the terminals 202. After the terminals 202 are assembled to the housing body 102, the PLR 10 is slid forward in the slots 132 and 138 to the position shown in FIGS. 7 and 8 with cross members 46 and 48 of locking features 35 and 37 engaged behind the second stage ramp locks 140 and 146.

Figure 8:
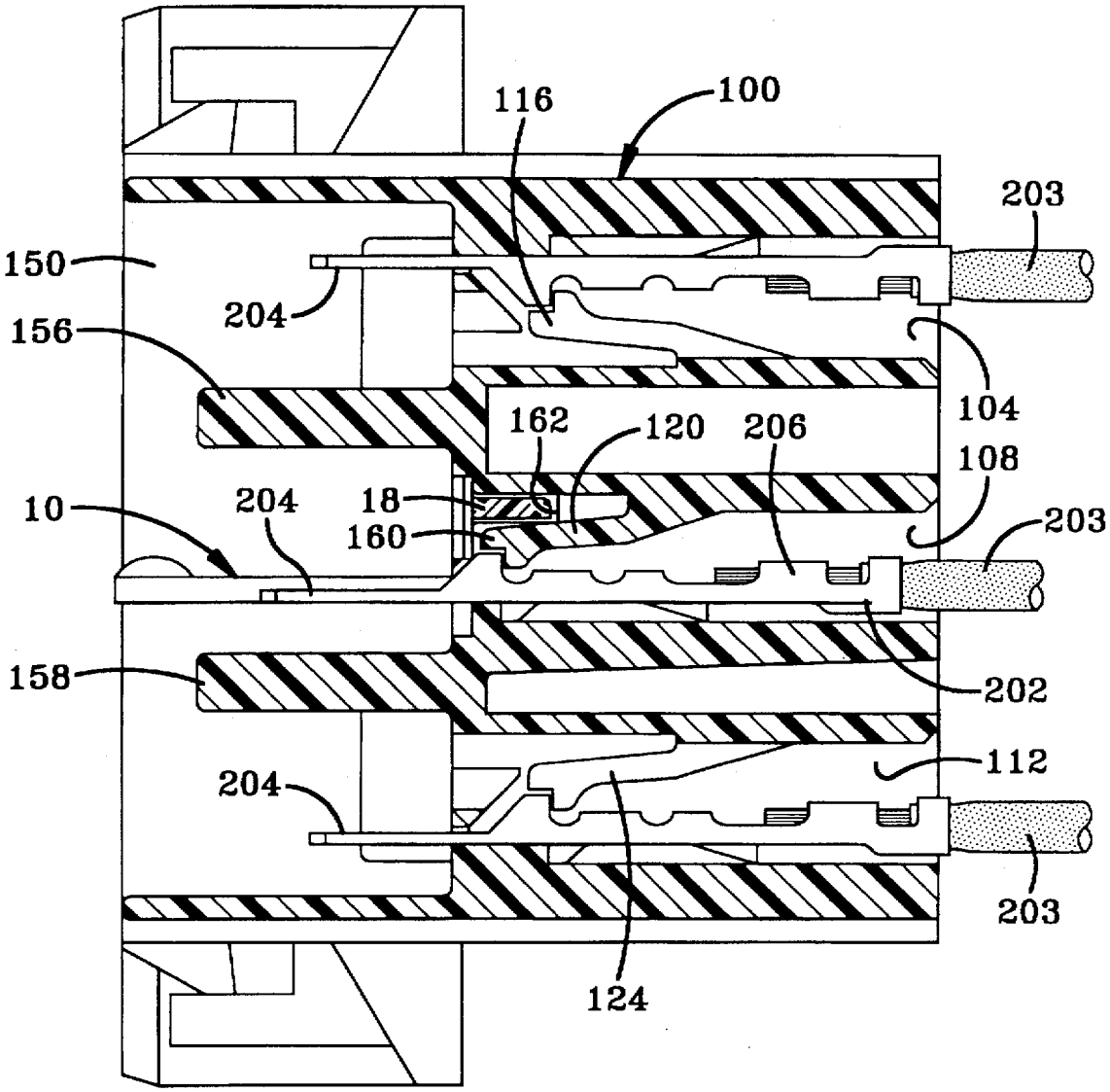

As is shown in FIG. 8, when in the second stage, the tab 18 occupies the space 162 above the end 160 of the spring arm 120, thus preventing the spring arm 120 from deflecting from the locked position in which it retains terminal 202 in place and thus locking terminal 202 securely in place within the housing body 102.

As described herein, an easy procedure for assembling the PLR 10 to the housing 102 is achieved by securing PLR 10 in the first stage before assembly of the terminals 202 and then simply sliding the PLR 10 to the second stage after terminals 202 are inserted properly within the housing 102. If the PLR 10 will not slide to the second stage, it may be an indication that the terminal 202 is not yet secured properly within the housing 102 and the spring arm 120 is not yet returned to its position shown in FIG. 8 in which it is locking the terminal 202 properly in place.

The cross member 82, connected between the opposing locking features 35, 37, translate opposing forces imparted on the lock features 35, 37 when they are slid over the ramp locks 140, 142, 144, 146. The net result is that the cross member 82 maintains the ends of the guides 78 and 80 within the slots 132 and 138, forcing torsional reaction of the retaining features 35 and 37 when they slide over the ramp locks 140, 146. If desired, the first stage ramp lock features 142 and 144 can be provided with the leading ramps having slopes or angles different from the slopes or angles of the leading ramps of second stage ramp lock features 140 and 146. With different slopes on the ramps and/or different heights of the ramps, each of the first and second stages are then provided with distinct feels to the operator. For example, a ramp having a smaller angle with respect to the slots 132, 138 requires less force for the lock feature 35, 37 to pass than ramps having greater angles with respect to the slots.

I claim:

1. An electrical connector with positive lock retention comprising:

a connector housing with a first wall having first and second ramp locks extending at first and second longitudinal positions from the first wall wherein the first and second ramp locks are spaced laterally apart from each other, wherein the first wall and the first second ramp locks define a first slot; and a positive lock retainer comprising a first longitudinally extending lock feature including a first longitudinal extension and a first cross member extending first and second lateral directions from the first longitudinal extension, wherein the first longitudinal extension engages and longitudinally slides in the first slot, wherein the positive lock retainer is locked in a first stage of insertion engagement with the connector housing when the first cross member is locked behind the first ramp lock and located longitudinally between the first and second ramp locks and wherein the positive lock retainer is locked in a second stage of insertion engagement with the connector housing when the first cross member is locked behind the second ramp lock, wherein in the second stage of insertion engagement, said positive lock retainer locks a terminal securely in place in the connector housing.

2. An electrical connector with positive lock retention according to claim 1, also comprising a first guide portion extending beyond the first cross member.

3. An electrical connector with positive lock retention according to claim 2, wherein the first and second ramp locks are diagonally opposed to each other and wherein, in an initial assembly stage, the first guide portion slides between the diagonally opposed ramp locks positionally guiding the positive lock retainer into the housing.

4. An electrical connector with positive lock retention according to claim 1, wherein the first longitudinally extending lock feature extends out of an end wall, also comprising:

a first longitudinally extending cavity within which the first wall is located;

a second longitudinally extending cavity within the connector housing;

a spring arm within the cavity extending at an angle to a longitudinal axis of the cavity, wherein the spring arm has a first end attached to the housing and a freely suspended end distal from the first end; and a tab extending out of the end wall, wherein the tab extends into the second longitudinally extending cavity proximate to the freely suspended end when the positive lock retainer is in the second stage, wherein the tab prevents cantilever deflection of the spring arm.

5. An electrical connector with positive lock retention according to claim 4, also comprising an electrical terminal maintained in place within the second cavity by the flex arm.

6. An electrical connector with positive lock retention according to claim 4, also comprising:

a second wall facing the first wall in the first cavity;

third and fourth ramp locks at third and fourth longitudinal positions along the second wall, wherein the first and third ramp locks are collateral within the first cavity and wherein the second and fourth ramp locks are collateral within the first cavity;

on the positive lock retention component, a second longitudinally extending lock feature including a second cross member extending first and second lateral directions therefrom, wherein the second cross member is parallel to the first cross member, wherein in the first state, the second cross member is located longitudinally between the third and fourth ramp locks and wherein in the second state the second cross member is locked behind the fourth ramp lock.

7. An electrical connector with positive lock retention according to claim 6, also comprising a first guide portion extending beyond the first cross member on the first lock feature and a second guide portion extending beyond the second cross member on the second lock feature.

8. An electrical connector with positive lock retention according to claim 7, also comprising, a third cross member connecting ends of the first and second guide portions.

9. An electrical connector with positive lock retention according to claim 1 wherein the first and second ramp locks are located on first and second rails on the first wall, respectively, and wherein the first and second rails define side walls of the first slot within which the first lock feature slides during engagement of the positive lock retainer to the connector housing.

10. An electrical connector with positive lock retention according to claim 6 wherein the first and second ramp locks are located on first and second rails on the first wall, wherein the third and fourth ramp locks are located on third and fourth rails on the second wall, wherein the first and second rails define side walls of the first slot within which the first lock feature slides during engagement of the positive lock retainer to the connector housing and wherein the third and fourth rails define side walls of the second slot within which the second lock feature slides during engagement of the positive lock retainer to the connector housing.

* * * * *